United States Patent [19]

D'Amato

[11] Patent Number: 4,590,404

[45] Date of Patent: May 20, 1986

[54] CATHODE-RAY TUBE HAVING A FACEPLATE WITH DECREASING CENTER-TO-EDGE THICKNESS

[75] Inventor: Ralph J. D'Amato, Lancaster, Pa.

[73] Assignee: RCA Corporation, Princeton, N.J.

[21] Appl. No.: 595,522

[22] Filed: Mar. 30, 1984

[51] Int. Cl.[4] ..... H01J 29/86

[52] U.S. Cl. ..... 313/477 R; 220/2.1 A

[58] Field of Search ..... 313/477 R; 220/2.1 R, 220/2.1 A

[56] References Cited

U.S. PATENT DOCUMENTS 2,728,012 12/1955 Swedlund ..... 220/2.1 A

FOREIGN PATENT DOCUMENTS 1358161 6/1974 United Kingdom ..... 313/477

*Primary Examiner*—Palmer C. DeMeo
*Assistant Examiner*—Sandra L. O'Shea
*Attorney, Agent, or Firm*—Eugene M. Whitacre; Dennis H. Irlbeck

[57] ABSTRACT

An improved cathode-ray tube includes an envelope comprising a faceplate panel, a funnel and a neck. The faceplate panel includes a transparent rectangular faceplate having a cathodoluminescent screen on an interior surface thereof. The faceplate has a vertical minor axis and a horizontal major axis. The improvement comprises the thickness of the faceplate being less near the ends of at least one of the major or minor axes than at its center, whereby the viewing angle in at least one direction is increased. In a preferred embodiment, the thickness of the faceplate increases from center-to-edge along its minor axis and decreases from center-to-edge along its major axis.

3 Claims, 5 Drawing Figures

CATHODE-RAY TUBE HAVING A FACEPLATE WITH DECREASING CENTER-TO-EDGE THICKNESS

This invention relates to cathode-ray tubes and, particularly, to cathode-ray tube faceplates having a decreasing center-to-edge thickness along at least one of their major and minor axes.

BACKGROUND OF THE INVENTION

There are two basic faceplate panel contours utilized commercially for rectangular cathode-ray tubes having screen sizes greater than about 23 cm diagonal: spherical, and cylindrical. Although flat contours are possible, the added thickness and weight of the faceplate panel required to maintain the same envelope strength are undesirable. Furthermore, if a flat faceplate cathode-ray tube is a shadow mask color picture tube, the additional weight and complexity of an appropriate shadow mask also are undesirable.

Recently, it has been suggested that spherically-shaped cathode-ray tube faceplate panels be improved by increasing the radius of curvature of the panels by a factor of 1.5 to 2. Such increase in radius of curvature reduces the curvature of the faceplate panel, thereby apparently permitting more satisfactory off-axis viewing of a tube screen.

Another new faceplate panel contour concept which creates the illusion of flatness is disclosed in three co-pending U.S. Applications: Ser. No. 469,772, filed by F. R. Ragland, Jr. on Feb. 25, 1983; Ser. No. 469,774, filed by F. R. Ragland, Jr. on Feb. 25, 1983; and Ser. No. 469,775, filed by R. J. D'Amato et al. on Feb. 25, 1983. The faceplate contour has curvature along both the major and minor axes of the faceplate panel, but is non-spherical. In a preferred embodiment described in these applications, the peripheral border of the tube screen is nearly planar.

When a faceplate panel is made with less curvature, the thickness of the panel must be increased to maintain the structural integrity of the tube envelope. This increase in thickness usually is achieved by adding more wedging to the faceplate panel. Wedging is a center-to-edge thickness increase in a faceplate panel. In prior art tubes, wedging in the order of 1 to 4 mm is present along the diagonals and the major and minor axes of the faceplate panels. Because of this wedging of faceplate panels, the full potential for off-axis viewing through the above-mentioned newer faceplate panels contours cannot be realized.

The present invention provides a novel faceplate panel thickness variation that provides significantly improved off-axis viewing of a cathode-ray tube.

SUMMARY OF THE INVENTION

The present invention provides an improvement in a cathode-ray tube including an envelope comprising a faceplate panel, a funnel and a neck. The faceplate panel includes a transparent rectangular faceplate having a cathodoluminescent screen on an interior surface thereof. The faceplate has a minor axis and a major axis. The improvement comprises the thickness of the faceplate being less near the ends of at least one of the major and minor axes than at its center.

In a preferred embodiment, the thickness of the faceplate increases from center-to-edge along its minor axis and decreases from center-to-edge along its major axis.

DETAILED DESCRIPTION OF THE PREFERRED EMBODIMENTS

Figure 1:
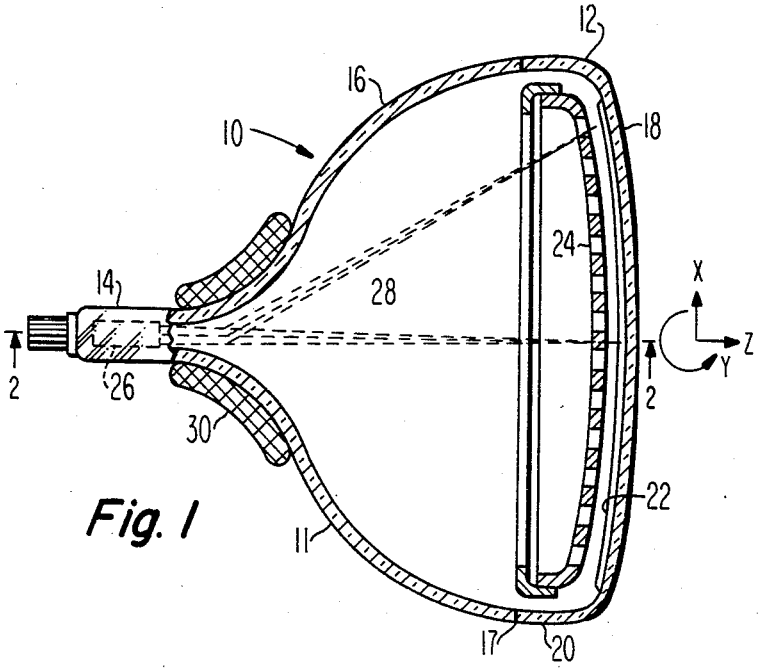
FIG. 1 is a plan view, partly in axial section, of a cathode-ray tube incorporating one embodiment of the present invention.
Figure 2:
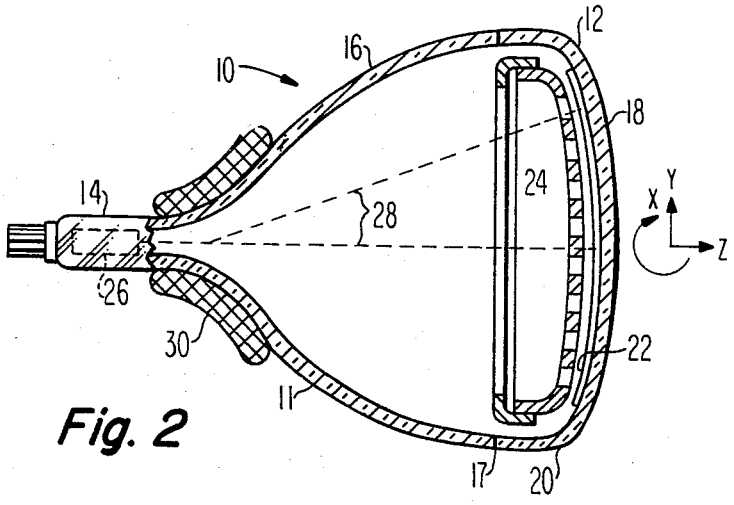
FIG. 2 is a side view, partly in axial section, of the cathode-ray tube taken at line 2—2 of FIG. 1.

FIGS. 1 and 2 show a rectangular cathode-ray tube (CRT), in the form of a color picture tube 10 having a glass envelope 11, comprising a rectangular faceplate panel 12 and a tubular neck 14 connected by a funnel 16. The panel comprises a viewing faceplate 18 and a peripheral flange or sidewall 20, which is sealed to the funnel 16 by a glass frit 17. A rectangular three-color cathodoluminescent phosphor screen 22 is carried by the inner surface of the faceplate 18. The screen is preferably a line screen, with the phosphor lines extending substantially parallel to the minor axis Y—Y of the tube (normal to the plane of FIG. 1 and parallel to the plane of FIG. 2). Alternatively, the screen may be a dot screen. A multi-apertured color selection electrode or shadow mask 24 is removably mounted within the faceplate panel 12 in predetermined spaced relation to the screen 22. An inline electron gun 26, shown schematically by dotted lines in FIGS. 1 and 2, is centrally mounted within the neck 14 to generate and direct three electron beams 28 along coplanar convergent paths through the mask 24 to the screen 22. Alternatively, the electron gun may have a triangular or delta configuration.

The tube 10 of FIGS. 1 and 2 is designed to be used with an external magnetic deflection yoke, such as the yoke 30 schematically shown surrounding the neck 14 and funnel 16 in the neighborhood of their junction, for subjecting the three beams 28 to vertical and horizontal magnetic flux, to scan the beams horizontally in the direction of the major axis (X—X) and vertically in the direction of the minor axis (Y—Y), respectively, in a rectangular raster over the screen 22.

The faceplate 18, as shown in FIGS. 1 and 2, has different center-to-edge thickness variations along its major and minor axes, X—X and Y—Y, respectively. The thickness of the faceplate 18 increases from center-to-edge along its minor axis Y—Y and slightly decreases from center-to-edge along its major axis X—X. As a result of this variation, the thickness of the faceplate 18 is less near the ends of the major axis X—X than near the ends of the minor axis Y—Y.

As compared to equivalent size prior art cathode-ray tube faceplates, the present faceplate 18 is thinner near the ends of the major axis, but thicker near the ends of the minor axis. The present faceplate 18 also is thicker than equivalent size prior art faceplates near the faceplate edges in cross-sections that are parallel to the minor axis. This increased thickness near the ends of the minor axis and near the ends of cross-sections parallel to the minor axis is necessary to compensate for the loss of faceplate strength caused by thinning of the faceplate near the ends of the major axis.

Preferably, the interior surface of the faceplate 18, along the major axis X—X, at the edges of the screen 22, approximately parallels the adjacent exterior surface of the faceplate. The reasons for this approximately parallel relationship are discussed as follows.

GENERAL CONSIDERATIONS

Figure 3:
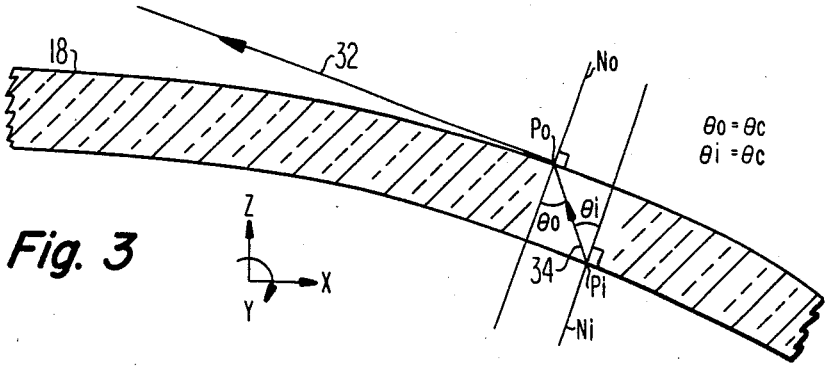
FIG. 3 is a sectional partial view of a faceplate near an end of its major axis, which is constructed in accordance with the present invention, illustrating an extreme light ray path.
Figure 4:
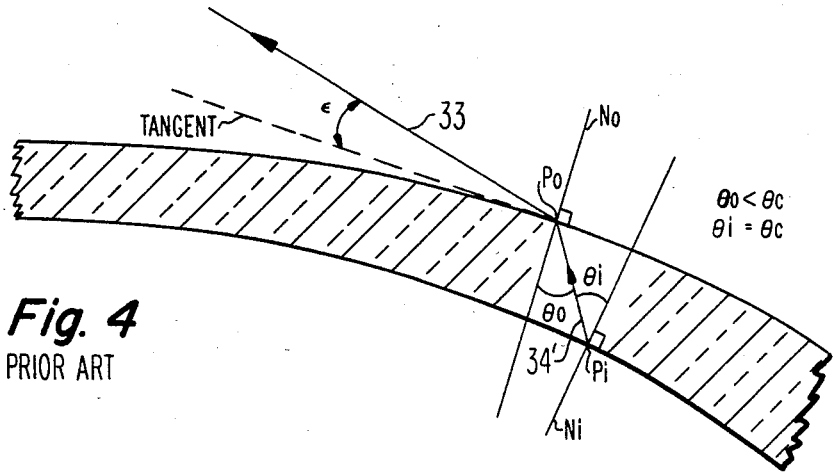
Fig. 4 PRIOR ART
FIG. 4 is a sectional partial view of a prior art faceplate near an end of its major axis, illustrating an extreme light ray path.
Figure 5:
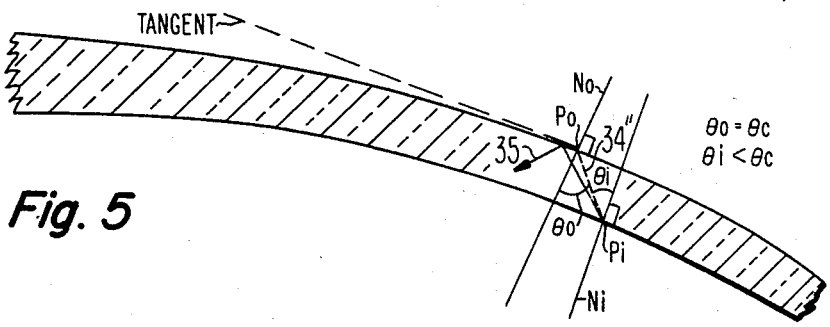
FIG. 5 is a sectional partial view of another faceplate near an end of its major axis, illustrating an internally reflected light ray path.

Maximum horizontal viewing angle occurs when the tangential or horizontal light rays from the far side of the screen are visible. For a tangential ray 32 to exit from the point $P_o$ in FIG. 3, an internal ray 34 must exist, forming a critical angle $$\theta_c = \sin^{-1}(1/\mu_{glass})$$

to the normal $N_o$ at the surface. For a refractive index of glass, $\mu$glass, of 1.52, the critical angle $\theta_c$ is 41.14 degrees. This internal ray emanates from phosphor particles at point $P_i$, from which rays emanate into the panel over an angle of 180°. Upon entry into the glass panel, the refracted rays are compressed into a cone with an apex angle $2\theta_c$ (82.28°) about the normal $N_i$. In FIGS. 3, 4 and 5, the angles between the normal $N_i$ at the point $P_i$ and the extreme visible internal rays 34, 34' and 34'' are designated $\theta_i$, and the angles between the normal $N_o$ at the point $P_o$ and the extreme visible internal rays 34, 34' and 34'' are designated $\theta_o$. The relationships of the angles $\theta_i$ and $\theta_o$ to the critical angle $\theta_c$ are shown in the drawings. For an internal ray to provide the necessary tangential ray, the normal $N_i$ must be parallel to the normal $N_o$ or converge on the front side of the panel. If the normals converge on the screen side of the faceplate panel, the rays 34' at the extreme of the $2\theta_c$ cone will be incident to $N_o$ at an angle less than $\theta_c$. For this condition, the last full intensity exit ray 33 is not tangential, as shown for the prior art faceplate of FIG. 4. Thus, the angle of view or maximum horizontal viewing angle is limited or reduced by an angle $\epsilon$, also shown in FIG. 4.

When the condition for maximum viewing angle and light output is met, $N_i$ is parallel to $N_o$ or $$(dz_i)/(dx) = f_i'(x_i) = (dz_o)/(dx) = f_o'(x_o),$$

where $f_i(x)$ and $f_o(x)$ are functions defining the inside and outside major axis contours, respectively. Since $F_i'(x)$ and $f_o'(x)$ monotonically decrease as x goes to zero, and $x_i > x_o$, then $$f_o'(x_o) > f_i', (x_o).$$

Therefore, the glass must have a negative wedge or decreasing thickness as x increases outwardly along the major axis from the center, to provide the maximum horizontal viewing angle. Maximum viewing angle will also occur if the wedging exceeds this condition, but with some loss of light output. This is illustrated in FIG. 5. All the rays 35 in the $2\theta_c$ cone beyond the dashed ray 34'' strike the front surface above the critical angle and are lost as internal reflections.

EXAMPLE

As an example of one preferred embodiment of the present invention, a cathode-ray tube, having a 69 cm (27 inch) diagonal viewing screen and an outside major axis faceplate radius of 1155 mm, includes an inside major axis faceplate radius of 1187 mm. The wedging angle at the ends of the major axis is 0.37 degree, which results in a minus 0.65 percent wedge. The thickness of the faceplate at its center is 13.3 mm, at the ends of the major axis is 12.5 mm, and at the ends of the minor axis is 16 mm. Because of the negative wedging of the faceplate, phosphor elements located at point $P_i$, as shown in FIG. 3, can be viewed near the tangent ray 32.

This preferred embodiment example can be compared to a prior art cathode-ray tube having a 62.5 cm (25 inch) diagonal viewing screen. The prior art tube has a faceplate outside radius of about 1070 mm (42.17 inches) and a faceplate inside radius of about 1034 mm (40.7 inches). Such outside and inside radii result in a positive wedge along both major and minor axes, such as shown in FIG. 4. In this prior art tube, the viewing angle loss, $\epsilon$, is about 7.23°. Therefore, the preferred embodiment example, having similar faceplate curvature as the prior art tube, with the inside radii of curvature varying by only about 32 mm, provides an increase or improvement in horizontal viewing angle of about 14.46°.

Although the preferred embodiment example is given with respect to a tube having a faceplate with circular cross-sections, it should be understood that the present inventive concept also is applicable to tubes having other curved cross-sections. Furthermore, it should be understood that although the invention has been described with respect to improving horizontal viewing angle, the principles of the invention are equally applicable to improving vertical viewing angle by adding reverse wedging along the minor axis of a faceplate. Of course, if glass thickness were appropriately increased to maintain strength, reverse wedging could be used along both major and minor axes to improve both vertical and horizontal viewing angle.

I claim:

1. In a cathode-ray tube including an envelope comprising a faceplate panel, a funnel and a neck, said faceplate panel including a transparent rectangular faceplate having a cathodoluminescent screen on an interior surface thereof, and said faceplate having a minor axis and a major axis, the improvement comprising the thickness of said faceplate increasing from center-to-edge along said minor axis and along cross-sections parallel to said minor axis, and decreasing from center-to-edge along said major axis.

2. The tube as defined in claim 1, wherein the interior surface of said faceplate along said major axis, at the edges of said screen, approximately parallels the adjacent exterior surface of said faceplate.

3. The tube as defined in claim 1, wherein the thickness of said faceplate also decreases from center-to-edge along cross-sections parallel to said major axis.

* * * * *